US009174442B2

(12) United States Patent
Murochi et al.

(10) Patent No.: US 9,174,442 B2
(45) Date of Patent: Nov. 3, 2015

(54) INKJET HEAD AND METHOD OF MANUFACTURING THE INKJET HEAD

(71) Applicant: TOSHIBA TEC KABUSHIKI KAISHA, Tokyo (JP)

(72) Inventors: Nobuaki Murochi, Shizuoka (JP); Hiroyuki Kushida, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/265,189

(22) Filed: Apr. 29, 2014

(65) Prior Publication Data

US 2014/0232793 A1 Aug. 21, 2014

Related U.S. Application Data

(62) Division of application No. 13/038,274, filed on Mar. 1, 2011, now Pat. No. 8,746,851.

(51) Int. Cl.

| | |
|---|---|
| ***B41J 2/015*** | (2006.01) |
| ***B41J 2/14*** | (2006.01) |
| ***B41J 2/16*** | (2006.01) |

(52) U.S. Cl.

CPC ..... *B41J 2/14201* (2013.01); *B41J 2/14209* (2013.01); *B41J 2/1609* (2013.01); *B41J 2/1628* (2013.01); *B41J 2/1629* (2013.01); *B41J 2/1631* (2013.01); *B41J 2202/19* (2013.01); *Y10T 29/49401* (2015.01)

(58) Field of Classification Search

None

See application file for complete search history.

(56) References Cited

U.S. PATENT DOCUMENTS

| | | | | |
|---|---|---|---|---|
| 5,543,009 | A * | 8/1996 | Hayes | 156/268 |
| 2008/0012911 | A1* | 1/2008 | Takabe et al. | 347/70 |
| 2010/0238237 | A1* | 9/2010 | Seki | 347/71 |

* cited by examiner

*Primary Examiner* — Erica Lin

(74) *Attorney, Agent, or Firm* — Patterson & Sheridan, LLP

(57) ABSTRACT

According to one embodiment, an inkjet head includes: a nozzle plate including plural nozzles; a piezoelectric element including plural pressure chambers corresponding to the nozzles and sidewalls provided adjacent to the pressure chambers and serving as driving elements configured to press the pressure chambers to eject liquid from the nozzles; a substrate to which the piezoelectric element is bonded; and a frame member placed on the substrate to surround the piezoelectric element. Grooves are formed on the upper end, and in which an adhesive is applied to bond the upper ends of the sidewalls and the nozzle plate.

12 Claims, 6 Drawing Sheets

INKJET HEAD AND METHOD OF MANUFACTURING THE INKJET HEAD

CROSS-REFERENCE TO RELATED APPLICATION

This application is a divisional of U.S. patent application Ser. No. 13/038,274, filed Mar. 1, 2011, which is based upon and claims the benefit of priority from the prior Japanese Patent Application No. 2010-226802 filed on Oct. 6, 2010, the entire contents of which are incorporated herein by reference.

FIELD

Embodiments described herein relate generally to an inkjet head and a method of manufacturing the inkjet head.

BACKGROUND

An inkjet head used for an inkjet printer includes a base substrate, piezoelectric elements placed on the base substrate and engraved with channel grooves, a frame member placed on the base substrate to surround the piezoelectric elements, and a nozzle plate bonded to the upper ends of sidewalls of the channel grooves of the piezoelectric elements by an adhesive and having nozzle holes.

The inkjet head sucks ink into the inside of the channel grooves according to deformation of the piezoelectric elements in one direction and ejects the ink in the inside of the channel grooves from the nozzle holes according to deformation of the piezoelectric elements in another direction.

In the inkjet head in the past, if the adhesive is excessively applied to the upper ends of the sidewalls of the channel grooves of the piezoelectric elements, a large amount of the adhesive is extruded into the inside of the channel grooves serving as pressure chambers. If the adhesive is extruded more than expected, the capacity of the pressure chambers decreases and a specified amount of the ink cannot be ejected and ink arrival accuracy substantially falls.

The nozzle holes are drilled after the nozzle plate is bonded to the piezoelectric elements. If the adhesive reaches drilling positions of the nozzle holes, the nozzle holes are drilled in a deformed shape rather than a circular shape. When a nozzle plate having nozzle holes drilled therein in advance is bonded to the piezoelectric elements, if the adhesive reaches drilling positions of the nozzle holes, the nozzle holes are deformed without keeping a circular shape. If the nozzle holes are deformed, printing quality is adversely affected.

DETAILED DESCRIPTION

In general, according to one embodiment, an inkjet head includes: a nozzle plate including plural nozzles; a piezoelectric element including plural pressure chambers corresponding to the nozzles and sidewalls provided adjacent to the pressure chambers and serving as driving elements configured to press the pressure chambers to eject liquid from the nozzles; each of the sidewalls having an upper end facing to the nozzle plate; a substrate to which the piezoelectric element is bonded; and a frame member placed on the substrate to surround the piezoelectric element. Grooves which are formed on the upper end, and in which an adhesive is applied to bond the upper ends of the sidewalls and the nozzle plate.

Various embodiments will be described herein with reference to the accompanying drawings.

First Embodiment

Figure 1:
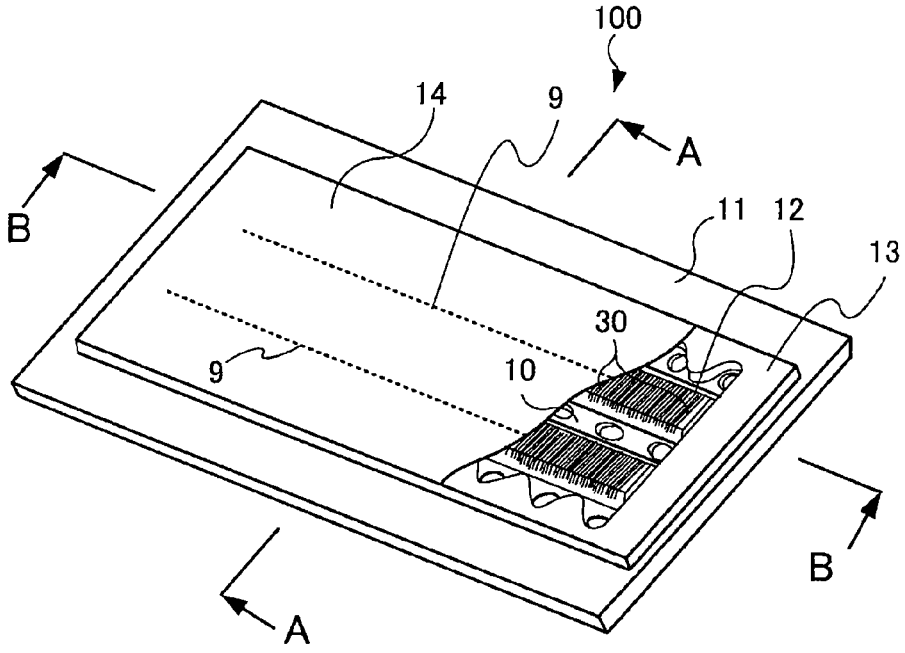
FIG. 1 is a diagram of the configuration of an inkjet head according to a first embodiment.
Figure 2:
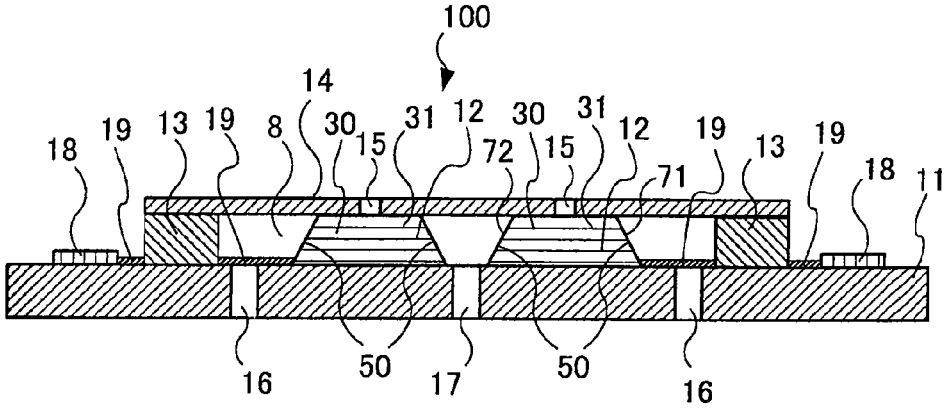
FIG. 2 is a sectional view taken along line AA in FIG. 1 of the inkjet head according to the first embodiment.
Figure 3:
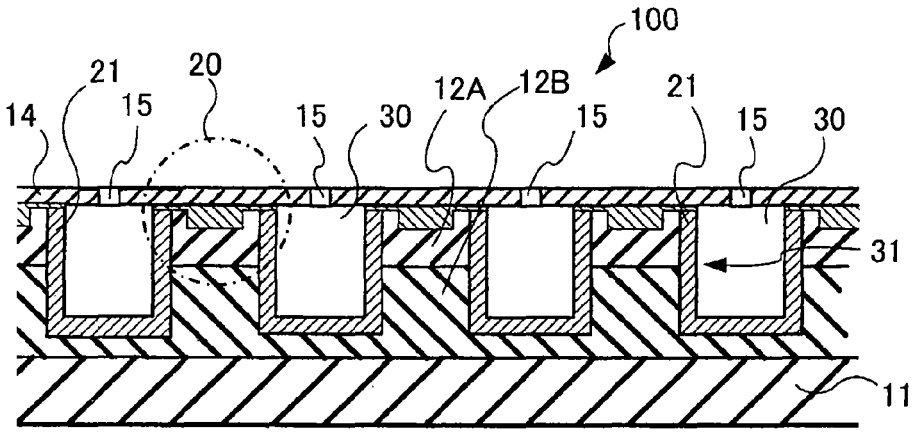
FIG. 3 is a sectional view taken along line BB in FIG. 1 of the inkjet head according to the first embodiment.

FIG. 1 is a diagram of the configuration of an inkjet head 100 according to a first embodiment. FIG. 2 is a sectional view taken along line AA in FIG. 1 of the inkjet head 100 according to the first embodiment. FIG. 3 is a sectional view taken along line BB in FIG. 1 of the inkjet head 100 according to the first embodiment. As shown in FIGS. 1 to 3, the inkjet head 100 includes a substrate 11 serving as a head forming member, piezoelectric elements 12 placed on the substrate 11, engraved with pressure chambers 30, and including grooves 22 at the upper ends of sidewalls 31 on the pressure chambers 30, a frame member 13 placed on the substrate 11 to surround the piezoelectric elements 12, and a nozzle plate 14 bonded to the upper ends of the sidewalls 31 of the piezoelectric elements 12 and having nozzle holes 15.

The inkjet head 100 includes a common liquid chamber 10 in a space surrounded by the substrate 11, the frame member 13, and the nozzle plate 14. The common liquid chamber 10 communicates with the pressure chambers 30.

The substrate 11 is formed in a square plate shape with an alumina dielectric. Plural ink suction holes 17 and plural ink discharge holes 16 are formed in the substrate 11 piercing through the substrate 11. The plural ink discharge holes 16 are formed side by side closer to an edge of the substrate 11 along a longitudinal direction of the substrate 11. The plural ink suction holes 17 are formed side by side substantially in the center of the substrate 11 along the longitudinal direction of the substrate 11. Plural electrodes 19 are provided on the substrate 11. As other materials of the substrate 11, ceramics such as PZT (lead titanate zirconate), aluminum nitride, and silicon nitride can also be used.

The nozzle plate 14 is formed of resin of polyimide. The nozzle plate 14 includes a pair of nozzle rows 9 in an upper part of the pressure chambers 30. Each of the nozzle rows 9 includes plural nozzle holes 15. The nozzle holes 15 function as ejection holes for ink droplets and formed at equal intervals. The nozzle plate 14 may be formed of other resin films. For example, a material of the nozzle plate 14 only has to be a material in which the nozzle holes 15 can be easily formed using a laser. A water-repellent film is formed of, for example, fluorine resin on the surface on the ink droplet ejection side of the nozzle plate 14.

The inkjet head 100 includes two rows of the piezoelectric elements 12 on the substrate 11. The piezoelectric elements 12 generate pressure for ejecting ink from the nozzles. As shown in FIG. 3, PZT (lead titanate zirconate) is used as a material of the piezoelectric elements 12. The piezoelectric elements 12 are formed by bonding first piezoelectric elements 12B and second piezoelectric elements 12A of PZT having a plate shape such that polarization directions thereof are opposed to each other. The piezoelectric elements 12 are formed in a trapezoidal shape in section and a bar shape extending in a main scanning direction. Each of the piezoelectric elements 12 in the trapezoidal shape has an upper end face and a slope face 50. Plural channel grooves extending in a direction (a sub-scanning direction) crossing the longitudinal direction (the main scanning direction) are formed on the surfaces of the piezoelectric elements 12. The piezoelectric elements 12 include the electrode 19 formed on the sidewalls 31 serving as driving elements provided on both sides of each of the channel grooves, the slopes and bottom surfaces of the channel grooves.

In such a structure, regions surrounded by the sidewalls 31, the bottom surfaces of the channel grooves, and the nozzle plate 14 form the plural pressure chambers 30 arranged in the main scanning direction.

The piezoelectric elements 12 are bonded on the substrate 11 to correspond to the nozzle rows 9 on the nozzle plate 14. The pressure chambers 30 and the sidewalls 31 are formed at a pitch same as the pitch of the nozzle holes 15 to respectively correspond to the nozzle holes 15.

A peripheral edge of the nozzle plate 14 is bonded to an end of the frame member 13 spaced apart from the substrate 11. An ink chamber 8 surrounded by the substrate 11, the frame member 13, and the nozzle plate 14 is formed.

The inkjet head 100 includes, on the outer side of the frame member 13, a driver IC 18 configured to drive the piezoelectric elements 12. The driver IC 18 and the piezoelectric element 12 are connected to the electrodes 19 on the substrate 11. One ends of the electrodes 19 on the substrate 11 are connected to the electrodes 19 on the piezoelectric elements 12. The other ends of the electrodes 19 on the substrate 11 are connected to the driver IC 18.

The inkjet head 100 configured as explained above is mounted on a printer. To perform printing, ink is supplied from an ink tank of the printer to the inkjet head 100. The ink supplied from the ink tank is filled in the pressure chambers 30 through the ink suction holes 17, the ink common liquid chamber 10, and the ink chamber 8. The ink not used in the pressure chambers 30 is collected in the ink tank through the ink discharge holes 16.

When a user instructs the printer to perform printing in this state, a control unit of the printer outputs a printing signal to the driver IC 18. The driver IC 18 that receives the printing signal applies a driving pulse voltage to the electrodes 19 on the piezoelectric elements 12 via the electrodes 19 on the substrate 11. Consequently, a pair of left and right sidewalls 31 present on both sides of the pressure chamber 30 selected to eject ink droplets are subjected to shear mode deformation and estranged to curve. The deformed sidewalls 31 are returned to initial positions to increase the pressure in the pressure chamber 30 to eject ink droplets from the nozzle hole 15 opposed to the pressure chamber 30.

As shown in FIG. 3, the inkjet head 100 includes the first piezoelectric elements 12B on the substrate 11 in a comb tooth shape in which concavities and convexities continue. At upper ends of convex portions of the first piezoelectric elements 12B, the inkjet head 100 includes the second piezoelectric elements 12A having polarity opposite to that of the first piezoelectric elements 12B and conductors 21 configured to cover the sidewalls 31 of the pressure chambers 30 in a C shape in section.

Figure 4:
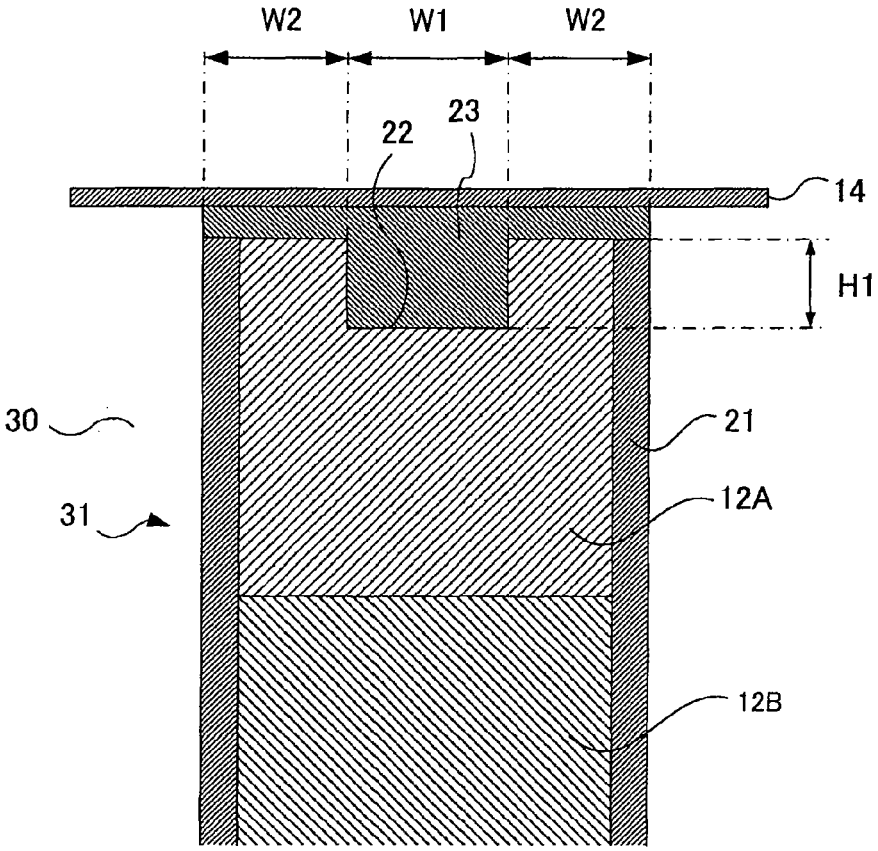
FIG. 4 is an enlarged diagram of a portion indicated by an alternate long and short dash line in FIG. 3 of the inkjet head according to the first embodiment.

FIG. 4 is an enlarged diagram of a portion indicated by an alternate long and short dash line 20 in FIG. 3 of the inkjet head 100 according to the first embodiment. As shown in FIG. 4, the inkjet head 100 includes the groove 22 at upper ends of the sidewalls 31 of the piezoelectric element 12, i.e., a surface opposite to the first piezoelectric element 12B on one end face side of the second piezoelectric element 12A.

If a width W2 of the convex portions on both sides of the groove 22 is equal to or larger than 10 μm and equal to or smaller than 30 μm, a width W1 of the groove 22 is equal to or larger than 30 μm and equal to or smaller than 70 μm. In other words, W2:W1 is 1:7 to 1:1.

A depth H1 of the groove 22 is desirably equal to or larger than 0.5 μm and equal to or smaller than 10 μm. If the depth H1 is smaller than 0.5 μm, the adhesive 23 is easily extruded from the groove 22 more than expected. If the depth H1 exceeds 10 μm, the strength of the upper ends of the sidewalls 31 is too low.

Method of Manufacturing the Inkjet Head According to the First Embodiment

First, the ink suction holes 17 and the ink discharge holes 16 are formed in the substrate 11, which is formed of a ceramic sheet before baking, by press molding. Alternatively, the substrate 11 having a rectangular plate shape is prepared and the ink suction holes 17 and the ink discharge holes 16 are formed by machining.

The piezoelectric element 12 obtained by bonding a pair of the first piezoelectric element 12B and the second piezoelectric element 12A with an adhesive to have polarization directions opposite to each other is bonded on the substrate 11 including the ink suction holes 17 and the ink discharge holes 16. As the adhesive for bonding the first piezoelectric element 12B and the second piezoelectric element 12A and the adhesive for bonding the piezoelectric element 12 to the substrate 11, for example, an epoxy adhesive that is hardened by heating is suitable.

The bonded piezoelectric element 12 is cut such that both side surfaces thereof along the longitudinal direction are tilted and a section thereof is formed in a trapezoidal shape.

Plural channel grooves (the pressure chambers 30) are cut from an upper part of the piezoelectric element 12 spaced apart from the substrate 11 using, for example, a diamond wheel of a dicing saw. The plural pressure chambers 30 are formed to be arranged at equal intervals along the longitudinal direction of the piezoelectric element 12. As a result, the sidewalls 31 are respectively formed among the pressure chambers 30 adjacent to one another.

The conductor 21 is formed on the sidewalls 31 of the pressure chamber 30, a slope 50 of the piezoelectric element 12, and the surface of the substrate 11. The conductor 21 is formed by a vacuum evaporation method, a sputtering method, a plating method, or the like.

More specifically, layers of Ni are formed by an electroless plating method and then Au layers are formed by an electrolytic plating method on the sidewalls 31 of the pressure chamber 30, the slope 50 of the piezoelectric element 12, and the surface of the substrate 11.

The conductor 21 at the upper ends of the sidewalls 31 of the pressure chamber 30 is removed by chemical etching or mechanically removed. Further, unnecessary portions of the conductor 21 on the slope 50 of the piezoelectric element 12 and the substrate 11 are removed by irradiating a laser to form the electrodes 19.

A photoresist layer is formed to cover the sidewalls 31 of the pressure chamber 30, the slope 50 of the piezoelectric element 12, and the surface of the substrate 11. The photoresist layer can be formed using a spray method, an electrodeposition method or a spinner method.

The photoresist layer in a portion corresponding to the groove 22 at the upper ends of the sidewalls 31 is removed using a photolithography method.

The second piezoelectric element 12A in the portion where the photoresist layer is removed is etched by thickness equal to or larger than 0.5 μm and equal to or smaller than 10 μm. For the etching, a wet etching method, a dry etching method, an ion milling method, or the like can be use.

The entire photoresist layer is removed. For the removing, a wet method or a dry method can be used.

The frame member 13 is bonded to the substrate 11. As the adhesive, for example, a thermosetting epoxy adhesive is suitable.

The nozzle plate 14 is bonded to the frame member 13 and the upper ends of the sidewalls 31 of the piezoelectric element 12 using an adhesive. A laser is irradiated on the nozzle plate 14 to drill the nozzle holes 15.

Alternatively, the nozzle plate 14 having the nozzle holes 15 drilled therein in advance is bonded to the frame member 13 and the upper ends of the sidewalls 31 of the piezoelectric element 12 using the adhesive. As the adhesive, a thermosetting epoxy adhesive is suitable.

The driver IC 18 is connected to the electrodes 19 on the substrate 11.

A not-shown ink case is bonded to the substrate 11.

According to the first embodiment, when the nozzle plate 14 is bonded to the piezoelectric element 12 by the adhesive, it is possible to suppress the excess adhesive from entering the grooves 22 and being extruded into the pressure chambers 30. In particular, adhesion of the adhesive around the nozzles is suppressed and ink arrival accuracy is not deteriorated.

Second Embodiment

The configuration on the section along line AA in FIG. 1 of an inkjet head 110 according to a second embodiment is the same as the configuration on the section along line AA in FIG. 1 of the inkjet head 100 according to the first embodiment.

Figure 5:
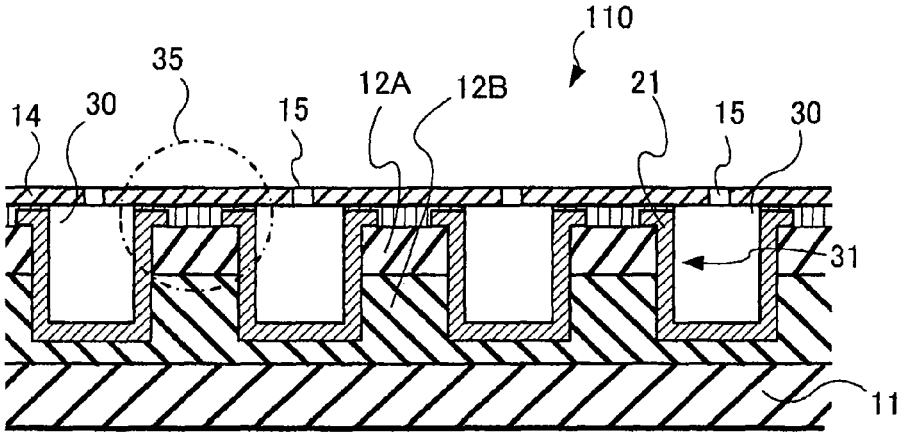
FIG. 5 is a sectional view taken along line BB in FIG. 1 of an inkjet head according to a second embodiment.

FIG. 5 is a sectional view taken along line BB in FIG. 1 of the inkjet head 110 according to the second embodiment. As shown in FIG. 5, the inkjet head 110 includes the first piezoelectric elements 12B on the substrate 11 in a comb tooth shape in which concavities and convexities continue. At upper ends of convex portions of the first piezoelectric elements 12B, the inkjet head 110 includes the second piezoelectric elements 12A having polarity opposite to that of the first piezoelectric elements 12B and the conductors 21 configured to cover the sidewalls 31 of the pressure chambers 30 in a C shape in section. The thickness of the conductors 21 is equal to or larger than 0.5 μm and equal to or smaller than 10 μm.

Figure 6:
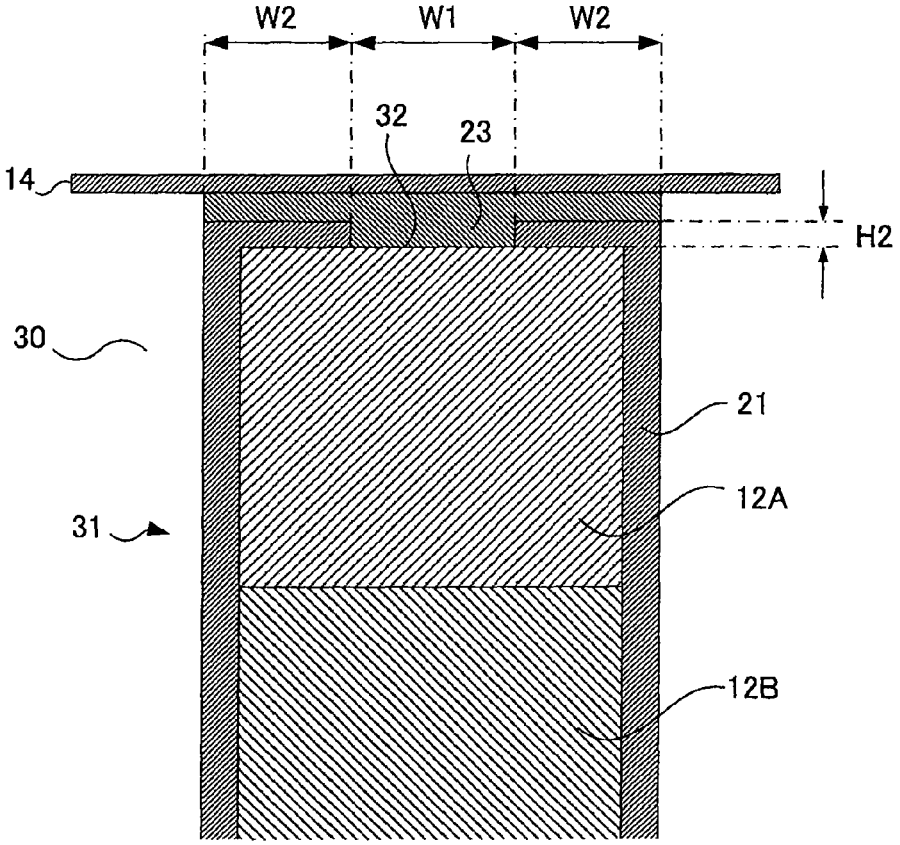
FIG. 6 is an enlarged diagram of a portion indicated by an alternate long and short dash line in FIG. 5 of the inkjet head according to the second embodiment.

FIG. 6 is an enlarged diagram of a portion indicated by an alternate long and short dash line 35 in FIG. 5 of the inkjet head 110 according to the second embodiment. As shown in FIG. 6, the inkjet head 110 includes a groove 32 at the upper ends of the sidewalls 31 of the piezoelectric element 12, i.e., a surface of the second piezoelectric element 12A opposite to the first piezoelectric element 12B. The sidewalls 31 and the one end face side of the piezoelectric element 12 are covered with the conductor 21. The groove 32 is formed by removing a part of the conductor 21.

If a width W2 of the convex portions on both sides of the groove 32 is equal to or larger than 10 μm and equal to or smaller than 30 μm, a width W1 of the groove 32 is equal to or larger than 30 μm and equal to or smaller than 70 μm. In other words, W2:W1 is 1:7 to 1:1.

A depth H2 of the groove 32 is equal to the thickness of the conductor 21. In other words, the depth H2 is equal to or larger than 0.5 μm and equal to or smaller than 10 μm. If the depth H2 is smaller than 0.5 μm, the adhesive 23 is easily extruded from the groove 32 more than expected. To form the groove 32 in the depth H2 exceeding 10 μm, it is necessary to provide a process for precisely caving the second piezoelectric element 12A.

Method of Manufacturing the Inkjet Head According to the Second Embodiment

First, the ink suction holes 17 and the ink discharge holes 16 are formed in the substrate 11, which is formed of a ceramic sheet before baking, by press molding. Alternatively, the substrate 11 having a rectangular plate shape is prepared and the ink suction holes 17 and the ink discharge holes 16 are formed by machining.

The piezoelectric element 12 obtained by bonding a pair of the first piezoelectric element 12B and the second piezoelectric element 12A with an adhesive to have polarization directions opposite to each other is bonded on the substrate 11 including the ink suction holes 17 and the ink discharge holes 16. As the adhesive for bonding the first piezoelectric element 12B and the second piezoelectric element 12A and the adhesive for bonding the piezoelectric element 12 to the substrate 11, for example, an epoxy adhesive that is hardened by heating is suitable.

The bonded piezoelectric element 12 is cut such that both side surfaces thereof along the longitudinal direction are tilted and a section thereof is formed in a trapezoidal shape.

Plural channel grooves (the pressure chambers 30) are cut from an upper part of the piezoelectric element 12 spaced apart from the substrate 11 using, for example, a diamond wheel of a dicing saw. The plural pressure chambers 30 are formed to be arranged at equal intervals along the longitudinal direction of the piezoelectric element 12. As a result, the sidewalls 31 are respectively formed among the pressure chambers 30 adjacent to one another.

The conductor 21 is formed on the sidewalls 31 of the pressure chamber 30, the slope 50 of the piezoelectric element 12, and the surface of the substrate 11. The conductor 21 is formed by a vacuum evaporation method, a sputtering method, a plating method, or the like.

More specifically, layers of Ni are formed by an electroless plating method and then Au layers are formed by an electrolytic plating method on the sidewalls 31 of the pressure chamber 30, the slope 50 of the piezoelectric element 12, and the surface of the substrate 11.

A photoresist layer is formed on the surface of the conductor 21. The photoresist layer can be formed using a spray method, a spinner method, or an electrodeposition method.

The photoresist layer in a portion corresponding to the groove 32 at the upper ends of the sidewalls 31 and the photoresist layer in unnecessary portions on the slope 50 of the piezoelectric element 12 and the conductor 21 on the substrate 11 are removed using a photolithography method.

The conductor 21 in the portion where the photoresist layer is removed in the upper parts of the sidewalls 31 and the conductor 21 in the portions where the photoresist layer is removed on the slope 50 of the piezoelectric element 12 and on the substrate 11 are etched by the thickness of the conductor 21 and removed. The thickness of the conductor 21 is equal to or larger than 0.5 μm and equal to or smaller than 10 μm. For the etching, a wet etching method, a dry etching method, an ion milling method, or the like can be use.

The entire photoresist layer is removed. For the removing, a wet method or a dry method can be used.

The frame member 13 is bonded to the substrate 11. As the adhesive, for example, a thermosetting epoxy adhesive is suitable.

The nozzle plate 14 is bonded to the frame member 13 and the upper ends of the sidewalls 31 of the piezoelectric element 12 using an adhesive. A laser is irradiated on the nozzle plate 14 to drill the nozzle holes 15.

Alternatively, the nozzle plate 14 having the nozzle holes 15 drilled therein in advance is bonded to the frame member 13 and the upper parts of the sidewalls 31 of the piezoelectric element 12 using the adhesive. As the adhesive, a thermosetting epoxy adhesive is suitable.

The driver IC 18 is connected to the electrodes 19 on the substrate 11.

A not-shown ink case is bonded to the substrate 11.

According to the second embodiment, it is possible to form the grooves 32 using the electrodes 19 on the piezoelectric elements 12, which are essential components of the inkjet head. Further, it is possible to form the grooves 32 in a process in which the electrodes 19 on the piezoelectric elements 12 and on the substrate 11 are formed. Therefore, it is possible to form the grooves 32 without adding a new material or a new process. Therefore, a manufacturing process is not complicated and cost can be suppressed.

Third Embodiment

The configuration on the section along line AA in FIG. 1 of an inkjet head 120 according to a third embodiment is the same as the configuration on the section along line AA in FIG. 1 of the inkjet head 100 according to the first embodiment.

Figure 7:
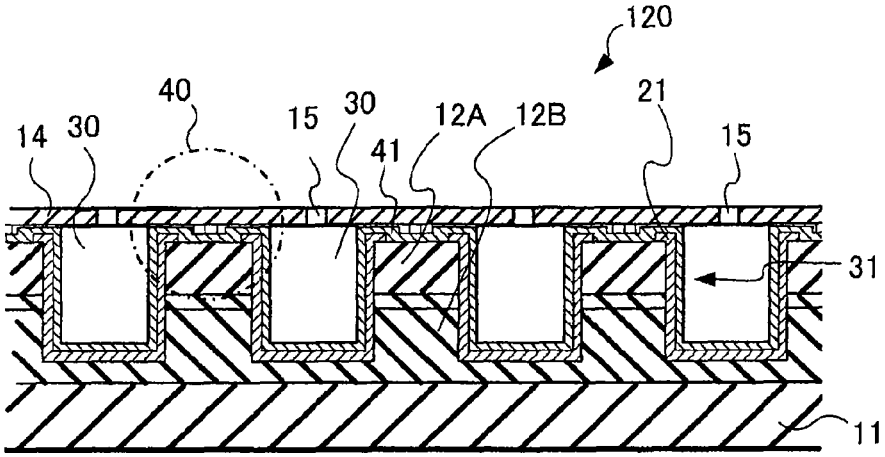
FIG. 7 is a sectional view taken along line BB in FIG. 1 of an inkjet head according to a third embodiment.

FIG. 7 is a sectional view taken along line BB in FIG. 1 of the inkjet head 120 according to the third embodiment. As shown in FIG. 7, the inkjet head 120 includes the first piezoelectric elements 12B on the substrate 11 in a comb tooth shape in which concavities and convexities continue. At upper ends of convex portions of the first piezoelectric elements 12B, the inkjet head 120 includes the second piezoelectric elements 12A having polarity opposite to that of the first piezoelectric elements 12B and the conductors 21 configured to cover the sidewalls 31 of the pressure chambers 30 in a C shape in section. The thickness of the conductors 21 is equal to or larger than 0.5 μm and equal to or smaller than 10 μm.

Figure 8:
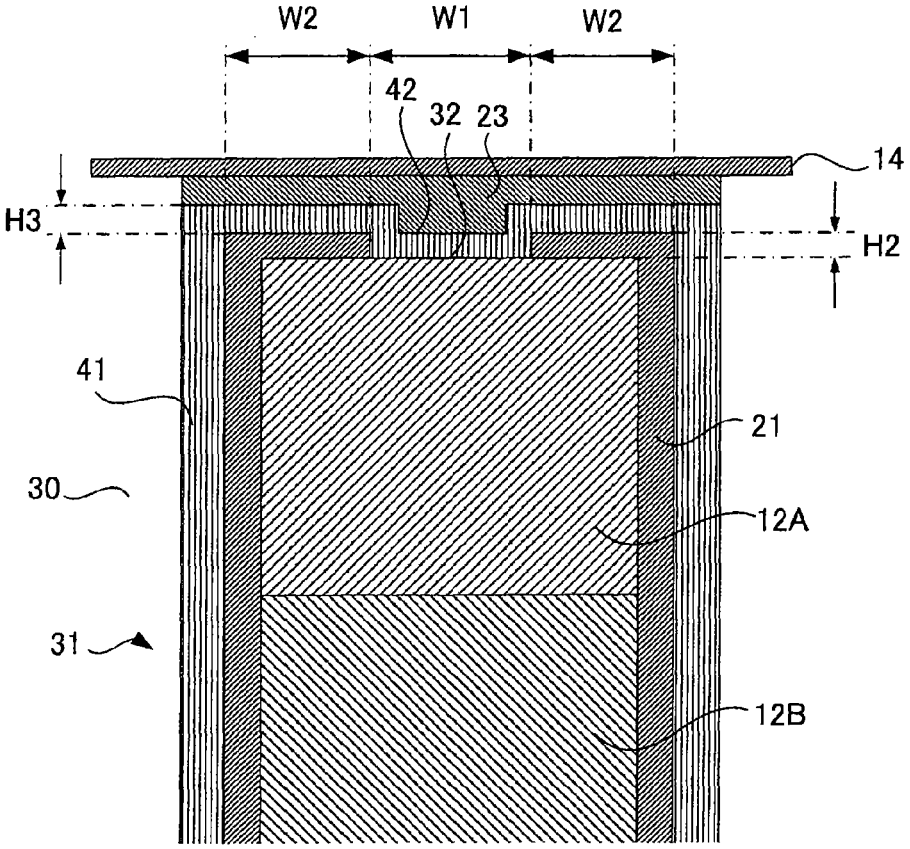
FIG. 8 is an enlarged diagram of a portion indicated by an alternate long and short dash line in FIG. 7 of the inkjet head according to the third embodiment.

FIG. 8 is an enlarged diagram of a portion indicated by an alternate long and short dash line 40 in FIG. 7 of the inkjet head 120 according to the third embodiment. As shown in FIG. 8, the inkjet head 120 includes the groove 32 at the upper ends of the sidewalls 31 of the piezoelectric element 12, i.e., a surface of the second piezoelectric element 12A opposite to the first piezoelectric element 12B. If a width W2 of the convex portions on both sides of the groove 32 is equal to or larger than 10 μm and equal to or smaller than 30 μm, a width W1 of the groove 32 is equal to or larger than 30 μm and equal to or smaller than 70 μm. In other words, W2:W1 is 1:7 to 1:1.

A depth H2 of the groove 32 is equal to the thickness of the conductor 21. In other words, the depth H2 is equal to or larger than 0.5 μm and equal to or smaller than 10 μm. If the depth H2 is smaller than 0.5 μm, the adhesive 23 is easily extruded from the groove 32 more than expected. To form the groove 32 in the depth H2 exceeding 10 μm, it is necessary to provide a process for precisely caving the second piezoelectric element 12A.

Further, the inkjet head 120 includes a protective film 41 configured to cover the conductor 21 and the upper ends of the sidewalls 31. The conductor 21, the one end face side of the piezoelectric element 12, and the groove 32 are covered with the protective film 41.

The thickness of the protective film 41 is equal to or larger than 2 μm and equal to or smaller than 10 μm. Therefore, a concave portion 42 is formed at the upper ends of the sidewalls 31 of the protective film 41. A depth H3 of the concave portion 42 is equal to or larger than 2 μm and equal to or smaller than 10 μm. The width of the concave portion 42 is smaller than the width W1 of the grooves 32 by thickness twice as large as the thickness of the protective film 41.

Method of Manufacturing the Inkjet Head According to the Third Embodiment

First, the ink suction holes 17 and the ink discharge holes 16 are formed in the substrate 11, which is formed of a ceramic sheet before baking, by press molding. Alternatively, the substrate 11 having a rectangular plate shape is prepared and the ink suction holes 17 and the ink discharge holes 16 are formed by machining.

The piezoelectric element 12 obtained by bonding a pair of the first piezoelectric element 12B and the second piezoelectric element 12A with an adhesive to have polarization directions opposite to each other is bonded on the substrate 11 including the ink suction holes 17 and the ink discharge holes 16. As the adhesive for bonding the first piezoelectric element 12B and the second piezoelectric element 12A and the adhesive for bonding the piezoelectric element 12 to the substrate 11, for example, an epoxy adhesive that is hardened by heating is suitable.

The bonded piezoelectric element 12 is cut such that both side surfaces thereof along the longitudinal direction are tilted and a section thereof is formed in a trapezoidal shape.

Plural channel grooves (the pressure chambers 30) are cut from an upper part of the piezoelectric element 12 spaced apart from the substrate 11 using, for example, a diamond wheel of a dicing saw. The plural pressure chambers 30 are formed to be arranged at equal intervals along the longitudinal direction of the piezoelectric element 12. As a result, the sidewalls 31 are respectively formed among the pressure chambers 30 adjacent to one another.

The conductor 21 is formed on the sidewalls 31 of the pressure chamber 30, the slope 50 of the piezoelectric element 12, and the surface of the substrate 11. The conductor 21 is formed by a vacuum evaporation method, a sputtering method, a plating method, or the like.

More specifically, layers of Ni are formed by an electroless plating method and then Au layers are formed by an electrolytic plating method on the sidewalls 31 of the pressure chamber 30, the slope 50 of the piezoelectric element 12, and the surface of the substrate 11.

A photoresist layer is formed on the surface of the conductor 21. The photoresist layer can be formed using a spray method, a spinner method, or an electrodeposition method.

The photoresist layer in a portion corresponding to the groove 32 at the upper ends of the sidewalls 31 and the photoresist layer in unnecessary portions on the slope 50 of the piezoelectric element 12 and the conductor 21 on the substrate 11 are removed using a photolithography method.

The conductor 21 in the portion where the photoresist layer is removed in the upper parts of the sidewalls 31 and the conductor 21 in the portions where the photoresist layer is removed on the slope 50 of the piezoelectric element 12 and on the substrate 11 are etched by the thickness of the conductor 21 and removed. The thickness of the conductor 21 is equal to or larger than 0.5 μm and equal to or smaller than 10 μm. For the etching, a wet etching method, a dry etching method, an ion milling method, or the like can be use.

The entire photoresist layer is removed. For the removing, a wet method or a dry method can be used.

The protective film 41 of an insulative member is formed to cover the conductor 21 and the upper ends of the sidewalls 31. For the formation of the protective film 41, a CVD method, a sputtering method, a vacuum evaporation method, an application method, or the like can be used.

The frame member 13 is bonded to the substrate 11. As the adhesive, for example, a thermosetting epoxy adhesive is suitable.

The nozzle plate 14 is bonded to the frame member 13 and the upper ends of the sidewalls 31 of the piezoelectric element 12 using an adhesive. A laser is irradiated on the nozzle plate 14 to drill the nozzle holes 15.

Alternatively, the nozzle plate 14 having the nozzle holes 15 drilled therein in advance is bonded to the frame member 13 and the upper parts of the sidewalls 31 of the piezoelectric element 12 using the adhesive. As the adhesive, a thermosetting epoxy adhesive is suitable.

The driver IC 18 is connected to the electrodes 19 on the substrate 11.

A not-shown ink case is bonded to the substrate 11.

According to the third embodiment, since the inkjet head 120 includes the protective film 41 configured to cover the conductor 21 and the upper ends of the sidewalls 31, there is an effect that it is possible to prevent corrosion of the conductor 21.

Fourth Embodiment

The configuration on the section along line AA in FIG. 1 of an inkjet head 130 according to a fourth embodiment is the same as the configuration on the section along line AA in FIG. 1 of the inkjet head 100 according to the first embodiment.

Figure 9:
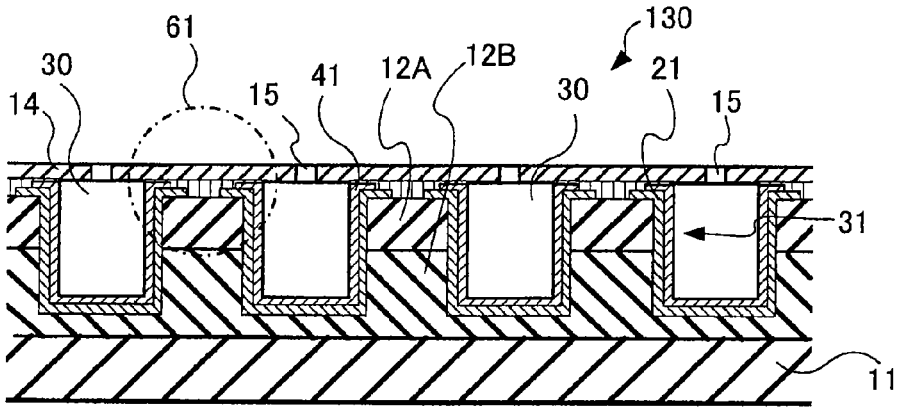
FIG. 9 is a sectional view taken along line BB in FIG. 1 of an inkjet head according to a fourth embodiment.

FIG. 9 is a sectional view taken along line BB in FIG. 1 of the inkjet head 130 according to the fourth embodiment. As shown in FIG. 9, the inkjet head 130 includes the first piezoelectric elements 12B on the substrate 11 in a comb tooth shape in which concavities and convexities continue. At upper ends of convex portions of the first piezoelectric elements 12B, the inkjet head 130 includes the second piezoelectric elements 12A having polarity opposite to that of the first piezoelectric elements 12B and the conductors 21 configured to cover the sidewalls 31 of the pressure chambers 30 in a C shape in section. The thickness of the conductors 21 is equal to or larger than 0.5 μm and equal to or smaller than 10 μm.

Figure 10:
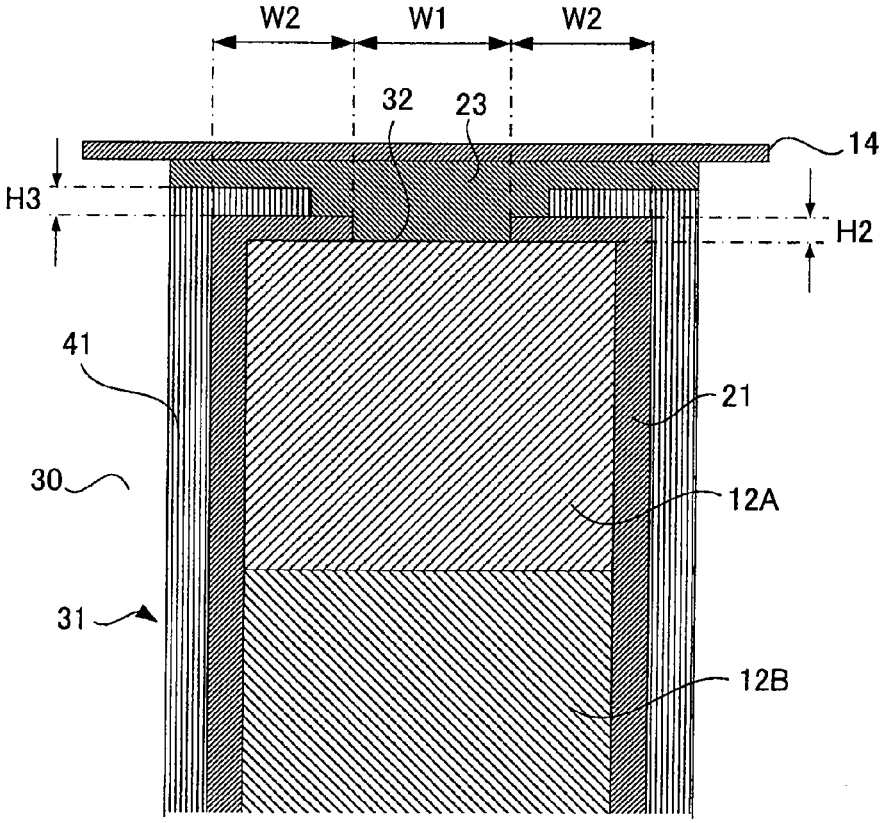
FIG. 10 is an enlarged diagram of a portion indicated by an alternate long and short dash line in FIG. 9 of the inkjet head according to the fourth embodiment.

FIG. 10 is an enlarged diagram of a portion indicated by an alternate long and short dash line 61 in FIG. 9 of the inkjet head 130 according to the fourth embodiment. As shown in FIG. 10, the inkjet head 130 includes the groove 32 at the upper ends of the sidewalls 31 of the piezoelectric element 12, i.e., a surface of the second piezoelectric element 12A opposite to the first piezoelectric element 12B. The groove 32 is formed by removing a part of the conductor 21 and a part of the protective film 41 on one end face side of the piezoelectric element 12.

If a width W2 of the convex portions on both sides of the groove 32 is equal to or larger than 5 μm, a ratio of the width W2 and a width W1 of concave portions in the groove 32 ranges from 1:7 to 1:1.

A depth H2 of the groove 32 is equal to the thickness of the conductor 21. In other words, the depth H2 is equal to or larger than 0.5 μm and equal to or smaller than 10 μm.

Further, the inkjet head 130 includes the protective film 41 configured to cover the conductor 21 and the upper ends of the sidewalls 31. The thickness of the protective film 41 is equal to or larger than 2 μm and equal to or smaller than 10 μm. A portion of the protective film 41 covering the groove 32 is removed.

If the depth H2+H3 is smaller than 0.5 μm, the adhesive 23 is easily extruded from the groove 32 more than expected. To form the groove 32 in the depth H2+H3 exceeding 10 μm, it is necessary to provide a process for precisely caving the second piezoelectric element 12A.

Method of Manufacturing the Inkjet Head According to the Fourth Embodiment

First, the ink suction holes 17 and the ink discharge holes 16 are formed in the substrate 11, which is formed of a ceramic sheet before baking, by press molding. Alternatively, the substrate 11 having a rectangular plate shape is prepared and the ink suction holes 17 and the ink discharge holes 16 are formed by machining.

The piezoelectric element 12 obtained by bonding a pair of the first piezoelectric element 12B and the second piezoelectric element 12A with an adhesive to have polarization directions opposite to each other is bonded on the substrate 11 including the ink suction holes 17 and the ink discharge holes 16. As the adhesive for bonding the first piezoelectric element 12B and the second piezoelectric element 12A and the adhesive for bonding the piezoelectric element 12 to the substrate 11, for example, an epoxy adhesive that is hardened by heating is suitable.

The bonded piezoelectric element 12 is cut such that both side surfaces thereof along the longitudinal direction are tilted and a section thereof is formed in a trapezoidal shape.

Plural channel grooves (the pressure chambers 30) are cut from an upper part of the piezoelectric element 12 spaced apart from the substrate 11 using, for example, a diamond wheel of a dicing saw. The plural pressure chambers 30 are formed to be arranged at equal intervals along the longitudinal direction of the piezoelectric element 12. As a result, the sidewalls 31 are respectively formed among the pressure chambers 30 adjacent to one another.

The conductor 21 is formed on the sidewalls 31 of the pressure chamber 30, the slope 50 of the piezoelectric element 12, and the surface of the substrate 11. The conductor 21 is formed by a vacuum evaporation method, a sputtering method, a plating method, or the like.

More specifically, layers of Ni are formed by an electroless plating method and then Au layers are formed by an electrolytic plating method on the sidewalls 31 of the pressure chamber 30, the slope 50 of the piezoelectric element 12, and the surface of the substrate 11.

A photoresist layer is formed on the surface of the conductor 21. The photoresist layer can be formed using a spray method, a spinner method, or an electrodeposition method.

The photoresist layer in a portion corresponding to the groove 32 in the upper parts of the sidewalls 31 and the photoresist layer in unnecessary portions on the slope 50 of the piezoelectric element 12 and the conductor 21 on the substrate 11 are removed using a photolithography method.

The conductor 21 in the portion where the photoresist layer is removed at the upper ends of the sidewalls 31 and the conductor 21 in the portions where the photoresist layer is removed on the slope 50 of the piezoelectric element 12 and on the substrate 11 are etched by the thickness of the conductor 21 and removed. The thickness of the conductor 21 is equal to or larger than 0.5 μm and equal to or smaller than 10 μm. For the etching, a wet etching method, a dry etching method, an ion milling method, or the like can be use.

The entire photoresist layer is removed. For the removing, a wet method or a dry method can be used.

The protective film 41 of an insulative member is formed to cover the conductor 21 and the upper ends of the sidewalls 31. For the formation of the protective film 41, a CVD method, a sputtering method, a vacuum evaporation method, an application method, or the like can be used.

A photoresist layer is formed to cover the surface of the protective film 41. The photoresist layer in the portion of the groove 32 is removed using the photolithography method.

The protective film 41 in the portion where the photoresist layer is removed is etched by the dry etching method or the ion milling method.

The entire photoresist film is removed.

The frame member 13 is bonded to the substrate 11. As an adhesive, for example, a thermosetting epoxy adhesive is suitable.

The nozzle plate 14 is bonded to the frame member 13 and the upper parts of the sidewalls 31 of the piezoelectric element 12 using an adhesive. A laser is irradiated on the nozzle plate 14 to drill the nozzle holes 15.

Alternatively, the nozzle plate 14 having the nozzle holes 15 drilled therein in advance is bonded to the frame member 13 and the upper ends of the sidewalls 31 of the piezoelectric element 12 using the adhesive. As the adhesive, a thermosetting epoxy adhesive is suitable.

The driver IC 18 is connected to the electrodes 19 on the substrate 11.

A not-shown ink case is bonded to the substrate 11.

According to the fourth embodiment, since the inkjet head 130 includes the protective film 41 configured to cover the conductor 21 and the upper ends of the sidewalls 31 and not cover the groove 32, there is an effect that it is possible to prevent corrosion of the conductor 21 and more surely prevent extrusion of an adhesive.

Fifth Embodiment

The configuration on the section along line AA in FIG. 1 of an inkjet head 140 according to a fifth embodiment is the same as the configuration on the section along line AA in FIG. 1 of the inkjet head 100 according to the first embodiment.

As the inkjet head 140 according to the fifth embodiment, any one of the inkjet heads 100, 110, 120, and 130 according to the first to fourth embodiments can be used.

Figure 11:
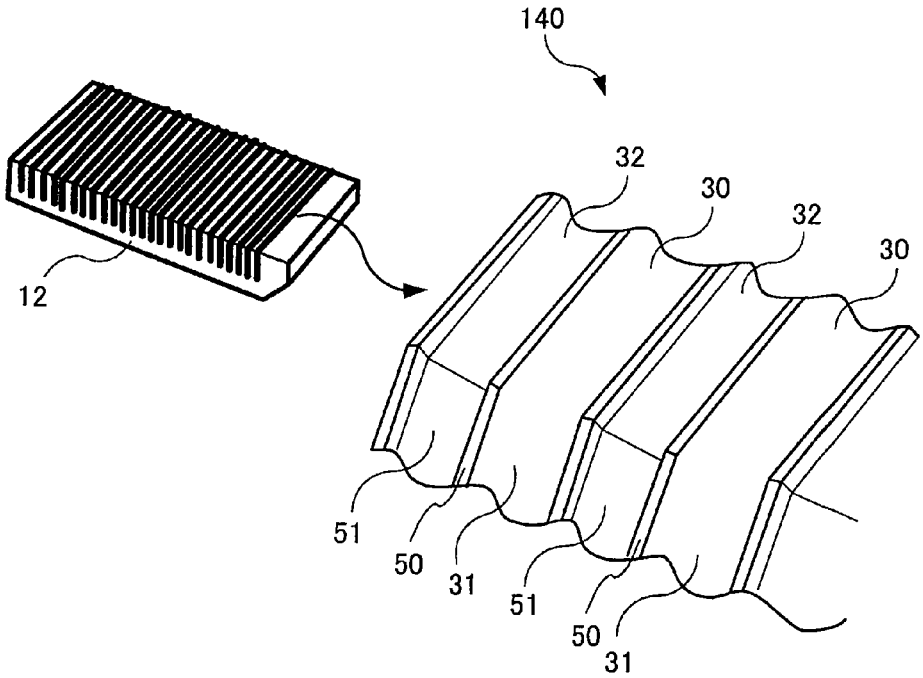
FIG. 11 is a diagram of the configuration of an inkjet head according to a fifth embodiment.

FIG. 11 is a diagram of the vicinity of the upper end of the piezoelectric element 12 of the inkjet head 140 according to the fifth embodiment. The inkjet head 140 according to the fifth embodiment further includes slope grooves 51 continuous to the grooves 22 or the grooves 32 on the slopes 50 formed continuous to the upper ends of the sidewalls 31 of any one of the inkjet heads 100, 110, 120, and 130 according to the first to fourth embodiments.

Method of Manufacturing the Inkjet Head According to the Fifth Embodiment

A method of forming the grooves 22 or the grooves 32 and the slop grooves 51 is explained below.

[1] A photoresist layer is formed on the sidewalls 31 of the pressure chambers 30, the slopes 50 of the piezoelectric element 12, and the surface of the substrate 11.

[2] The photoresist layer in portions corresponding to the grooves 22 or the grooves 32 at the upper ends of the sidewalls 31 and portions formed as the slop grooves 51 of the slopes 50 is removed.

[3] The piezoelectric element 12A, the conductors 21, or the protective films 41 in the portions where the photoresist layer is removed is etched by a wet etching method, a dry etching method, or an ion milling method.

[4] The entire photoresist layer is removed.

The grooves 22 or the grooves 32 and the slope grooves 51 are collectively formed according to steps [1] to [4].

Effects of the Fifth Embodiment

As explained above, the inkjet head 140 according to this embodiment further includes the slope grooves 51 continuous to the grooves 22 or the grooves 32 on the slopes 50 formed continuous to the upper ends of the sidewalls 31 of any one of the inkjet heads 100, 110, 120, and 130 according to the first to fourth embodiments.

Therefore, in the inkjet head 140 according to this embodiment, if an amount of the adhesive used for bonding the upper ends of the sidewalls 31 and the nozzle plate 14 is large, the excess adhesive is extruded in the direction of the slopes 50 and is less easily extruded in the direction of the nozzle holes 15. The slope grooves 51 suppress extrusion of the adhesive in the direction of an ink inflow port 71 or an ink outflow port 72 of the pressure chambers 30 shown in FIG. 2.

Therefore, there is an effect that a flow of ink is not hindered in the portions of the ink inflow port 71 or the ink outflow port 72 and the ink is uniformly supplied to the pressure chambers. Further, since the grooves 22 or 32 and the slope grooves 51 are continuously formed, there is an effect that it is easy to suppress extrusion of the adhesive within an assumption.

Further, since the grooves 22 or the grooves 32 and the slope grooves 51 can be simultaneously formed, there is an effect that it is possible to provide the inkjet head 140 according to minimum steps.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An inkjet head, comprising:

a substrate formed of a dielectric;

a piezoelectric element disposed on the substrate, including a pressure chamber, which has a space and a conductor on an inside thereof, and having grooves at upper ends of sidewalls of the pressure chamber, the conductor covering the sidewalls and one end-face side of the piezoelectric element, wherein the grooves are disposed in openings separating parts of the conductor;

a frame member disposed on the substrate to surround the piezoelectric element; and a nozzle plate bonded to the upper ends of the sidewalls and having nozzle holes.

2. The inkjet head according to claim 1, wherein the conductor, the one end face side of the piezoelectric element, and the grooves are covered with a protective film.

3. The inkjet head according to claim 2, wherein the grooves are further disposed in openings separating both the parts of the conductor and parts of the protective film on the one end face side of the piezoelectric element.

4. An inkjet head, comprising:

a substrate formed of a dielectric;

a piezoelectric element disposed on the substrate, including a pressure chamber, which has a space and a conductor on an inside thereof, and having grooves at upper ends of sidewalls of the pressure chamber;

a frame member placed on the substrate to surround the piezoelectric element; and a nozzle plate bonded to the upper ends of the sidewalls and having nozzle holes, wherein a width W2 of convex portions on both sides of the groove is equal to or larger than 5 μm, a ratio of the width W2 and a width W1 of concave portions in the groove ranges from 1:7 to 1:1.

5. An inkjet head, comprising:

a substrate formed of a dielectric;

a piezoelectric element disposed on the substrate, including a pressure chamber, which has a space and a conductor on an inside thereof, and having grooves at upper ends of sidewalls of the pressure chamber;

a frame member placed on the substrate to surround the piezoelectric element; and a nozzle plate bonded to the upper ends of the sidewalls and having nozzle holes, wherein the piezoelectric element includes a slope continuous to an upper end of the piezoelectric element and not in contact with the nozzle plate; and wherein the slope includes grooves continuous to the grooves at the upper ends of the sidewalls of the pressure chamber.

6. The inkjet head according to claim 4, wherein the sidewalls and the one end face side of the piezoelectric element are covered with the conductor, and the grooves are disposed in openings separating parts of the conductor.

7. The inkjet head according to claim 6, wherein the conductor, the one end face side of the piezoelectric element, and the grooves are covered with a protective film.

8. The inkjet head according to claim 7, wherein the grooves are further disposed in openings separating the parts of the conductor and parts of the protective film on the one end face side of the piezoelectric element.

9. The inkjet head according to claim 5, wherein the sidewalls and the one end face side of the piezoelectric element are covered with the conductor, and the grooves are disposed in openings separating parts of the conductor.

10. The inkjet head according to claim 9, wherein the conductor, the one end face side of the piezoelectric element, and the grooves are covered with a protective film.

11. The inkjet head according to claim 10, wherein the grooves are further disposed in openings separating both the parts of the conductor and parts of the protective film on the one end face side of the piezoelectric element.

12. The inkjet head according to claim 11, wherein a width W2 of convex portions on both sides of the groove is equal to or larger than 5 μm, a ratio of the width W2 and a width W1 of concave portions in the groove ranges from 1:7 to 1:1.

* * * * *